US005414994A

United States Patent [19]

Cullen et al.

[11] Patent Number: 5,414,994

[45] Date of Patent: May 16, 1995

[54] METHOD AND APPARATUS TO LIMIT A MIDBED TEMPERATURE OF A CATALYTIC CONVERTER

[75] Inventors: Michael J. Cullen, Northville; Woodrow Lewis, Jr., Ypsilanti; Michael A. Weyburne, Northville, all of Mich.; Stephen de la Salle, Billericay, United Kingdom; Todd A. Martin, Commerce Township, Oakland County, Mich.

[73] Assignee: Ford Motor Company, Dearborn, Mich.

[21] Appl. No.: 196,735

[22] Filed: Feb. 15, 1994

[51] Int. Cl.[6] ..... F01N 3/20

[52] U.S. Cl. ..... 60/274; 60/276; 60/277; 60/285

[58] Field of Search ..... 60/274, 276, 277, 285

[56] References Cited

U.S. PATENT DOCUMENTS 3,090,041 5/1963 Dell .
3,466,645 9/1969 Granberg et al. .
3,626,909 12/1971 Hayashida .
4,201,161 5/1980 Sasayama et al. .
4,383,456 5/1983 Ganoung .
4,393,837 7/1983 Sugihara et al. .
4,541,367 9/1985 Lindberg .
4,633,838 1/1987 Fukui .
4,656,829 4/1987 Creps et al. .
4,915,079 4/1990 Holmes .
5,136,514 8/1992 Laumann .
5,136,517 8/1992 Cullen et al. .
5,150,690 9/1992 Carter et al. .

*Primary Examiner*—Douglas Hart
*Attorney, Agent, or Firm*—Peter Abolins; Roger L. May

[57] ABSTRACT

An electronic engine controller limits the maximum temperature of a midbed point within a catalytic converter by determining an instantaneous temperature of the midbed point as a function of a temperature of exhaust gas at an exhaust flange, of a temperature variation of exhaust gas from the exhaust flange and exhaust gas inlet to the catalytic converter, of exhaust gas at an exhaust gas inlet to the catalytic converter, and as a function of a predetermined value indicative of a temperature rise of exhaust gas in the catalytic converter. The temperature is compared to a maximum midbed temperature range and a first air/fuel modulation variable is altered by a predetermined amount if the temperature of the midbed point is within the maximum midbed temperature range and the first air/fuel modulation variable is set to a predetermined value if the midbed temperature is below the maximum midbed temperature range. The first air/fuel modulation variable is compared to a second air/fuel modulation variable which corresponds to an air/fuel ratio required to produce a predetermined engine response and the rate of fuel delivery to the engine is altered to generate an air/fuel ratio corresponding to the air/fuel modulation variable which represents the richer air/fuel mixture.

15 Claims, 5 Drawing Sheets

METHOD AND APPARATUS TO LIMIT A MIDBED TEMPERATURE OF A CATALYTIC CONVERTER

FIELD OF THE INVENTION

This invention relates to methods and apparatus for determining a midbed temperature of a catalytic converter and for controlling the delivery of fuel to an internal combustion engine to maintain the midbed temperature below a predetermined maximum temperature.

BACKGROUND OF THE INVENTION

Modern automotive engines typically utilize a catalytic converter to reduce the exhaust gas emissions produced by the engine. Such converters operate to chemically alter the exhaust gas composition produced by the engine to help meet various environmental regulations governing tailpipe emissions. Catalytic converters typically operate at peak efficiency when the temperature of the catalytic material within the converter is within a certain specified temperature range. Continued operation of the converter at a temperature greater than the specified temperature range, however, leads to degradation of the catalyst material within the converter. Such degradation leads to reduced converter operating life and to increased tailpipe emissions.

Accordingly, there exists a need to accurately determine the operating temperature of a catalytic converter and to limit the temperature of the converter during vehicle operation.

SUMMARY OF THE INVENTION

It is an object of the present invention to increase the operating life of a catalytic converter on a vehicle engine by determining the temperature of the catalytic material within the converter and maintaining the temperature of the catalytic material below a predetermined maximum operating temperature.

In accordance with the present invention, the above object is achieved by determining a temperature of a midbed point within the catalytic converter, generating a first air/fuel modulation variable indicative of a ratio of air to fuel in an air/fuel mixture required to alter the temperature of the midbed point by a predetermined amount and generating a second air/fuel modulation variable indicative of a ratio of air to fuel in an air/fuel mixture required to generate a predetermined engine response for a predetermined set of engine operating parameters. The first air/fuel modulation variable is then compared to the second air/fuel modulation variable and an amount of fuel to generate an air/fuel mixture corresponding to the first air/fuel modulation variable is injected if the first air/fuel modulation variable corresponds to a lesser proportion of air to fuel in the air/fuel mixture than the second air/fuel modulation variable. An amount of fuel to generate an air/fuel mixture corresponding to the second air/fuel modulation variable is injected if the first air/fuel modulation variable corresponds to a greater proportion of air to fuel than the second air/fuel modulation variable.

An advantage of at least certain preferred embodiments is that tailpipe emissions and the cost of vehicle maintenance are decreased by operating the catalytic converter below a maximum operating temperature.

These and other features and advantages of the present invention may be better understood by considering the following detailed description of certain preferred embodiments of the invention. In the course of this description, reference will be made to the attached drawings.

DETAILED DESCRIPTION

Figure 1:
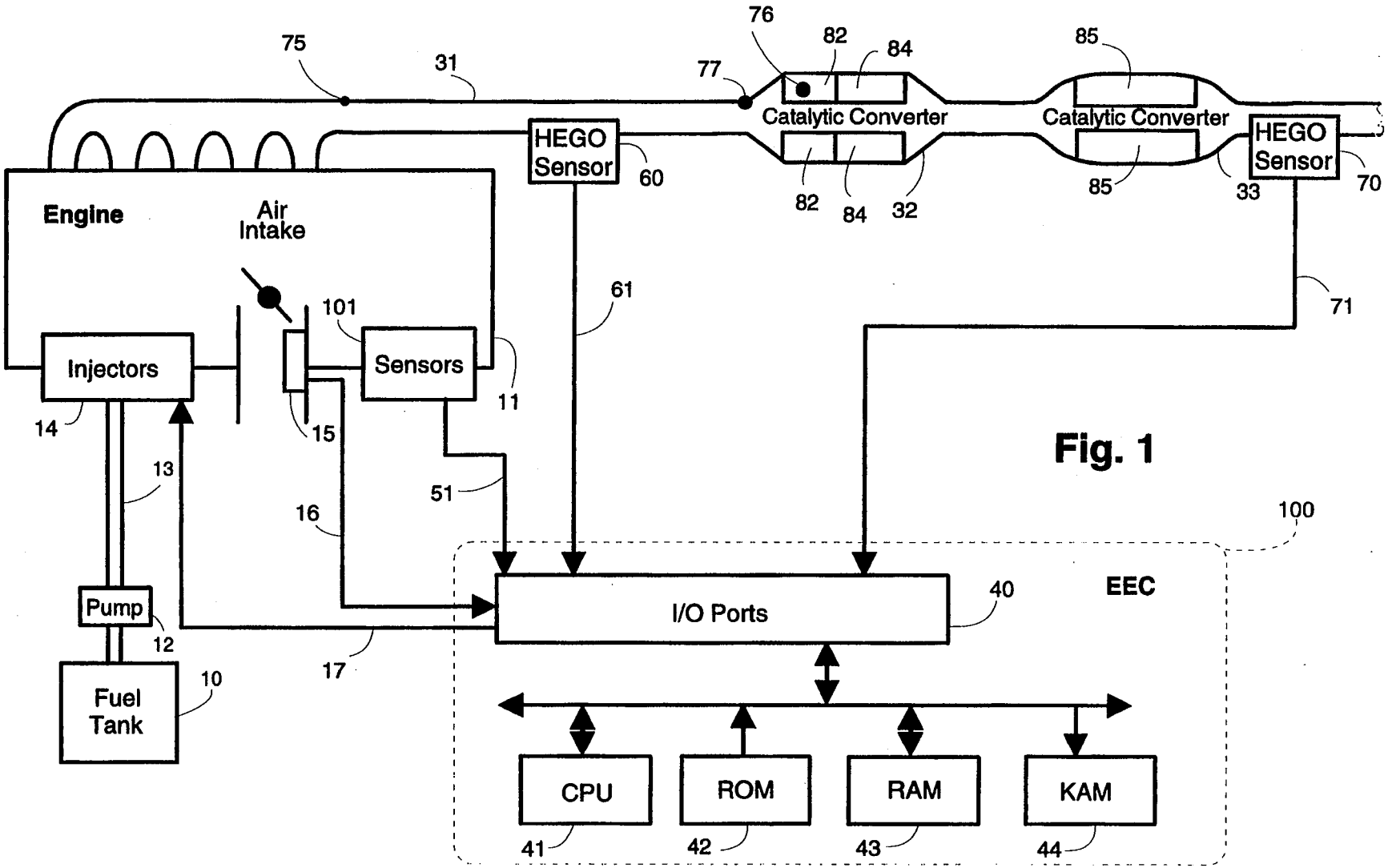
FIG. 1 is a schematic diagram of a vehicle engine and an electronic engine controller which embody the principles of the invention.

In FIG. 1 of the drawings a fuel pump 12 pumps fuel from a fuel tank 10 through a fuel line 13 to a set of fuel injectors 14 which inject fuel into an internal combustion engine 11. The fuel injectors 14 are of conventional design and are positioned to inject fuel into their associated cylinder in precise quantities as determined by an electronic engine controller (EEC) 100, transmitting a fuel injector signal to the injectors 14 via signal line 17. The fuel injector signal is varied over time by EEC 100 to maintain an air/fuel ratio determined by the EEC 100. The fuel tank 10 advantageously contains liquid fuels, such as gasoline, methanol or a combination of fuel types. An exhaust system 31, comprising one or more exhaust pipes and an exhaust flange seen at 75, transports exhaust gas produced from combustion of an air/fuel mixture in the engine to a first catalytic converter 32 and a second catalytic converter 33. First catalytic converter 32, which is shown in FIG. 1 in a cross-sectional view, contains a catalyst material, seen at 82 and 84, which chemically alters exhaust gas, which is produced by the engine and enters the converter 32 through exhaust gas inlet seen at 77, to generate a catalyzed exhaust gas which is then further chemically altered by second catalytic converter 33 which contains catalyst material seen at 85.

An upstream heated exhaust gas oxygen (HEGO) sensor 60, positioned upstream of the first catalytic converter 32 on the exhaust system 31 of the engine 11, detects the oxygen content of the exhaust gas generated by the engine 11, and transmits a representative signal 61 to the EEC 100. A downstream HEGO sensor 70, positioned downstream of the catalytic converter 32, detects the oxygen content of the catalyzed exhaust gas and transmits a representative signal 71 to the EEC 100. Still other sensors, indicated generally at 101, provide additional information about engine performance to the EEC 100, such as crankshaft position, angular velocity, throttle position, air temperature, etc. The information from these sensors is used by the EEC 100 to control engine operation.

A mass air flow sensor 15 positioned at the air intake of engine 11 detects the amount of air inducted into an induction system of the engine and supplies an air flow signal 16 to the EEC 100. Air flow signal 16 is utilized by EEC 100 to calculate a value termed air mass (AM) which is indicative of a mass of air flowing into the induction system in lbs./min. Air flow signal 16 is also used to calculate a value termed air charge (AIRCHG) which is indicative of air mass per cylinder filling, in units of lbs. per cylinder filling where a cylinder filling occurs once for each cylinder of the engine upon every two engine revolutions for a four-stroke engine. In another embodiment utilizing a two-stroke engine a cylinder filling occurs for each cylinder of the engine upon every engine revolution.

The EEC 100 comprises a microcomputer including a central processor unit (CPU) 41, input and output (I/O) ports 40, read only memory (ROM) 42 for storing control programs, random access memory (RAM) 43, for temporary data storage which may also be used for counters or timers, keep-alive memory (KAM) 44 for storing learned values, and a conventional data bus. EEC 100 also includes an engine off timer which generates a signal indicative of the period of time the engine was turned off. The information contained in the signal is stored in a variable termed ENG_OFF_TMR which is indicative of the period of time the engine was turned off.

In a preferred embodiment, the catalyst material 82 and 84 seen in first catalytic converter 32 and catalyst material 85 seen in second catalytic converter 33 each experience degradation when operated at a temperature greater than approximately 1550 degrees fahrenheit. A temperature at a midbed point, seen at 76, of the catalyst material is representative of the temperature of the catalyst material in converter 32. The midbed point is preferably located one inch from the initial point of contact of exhaust gas on the first catalyst material 82, at the axial centerline of first catalyst material 82.

In a preferred embodiment, during engine operation, the temperature of the midbed point is determined and an amount of fuel delivered by the injectors is altered to maintain the midbed temperature below a maximum temperature value, which in a certain preferred embodiment is approximately 1550 degrees fahrenheit. A preferred embodiment determines a temperature indicative of the temperature of the catalyst mass in first catalytic converter 32 and alters the rate at which fuel is delivered by injectors 14 to alter the composition of exhaust gas processed by first catalytic converter 32. In a preferred embodiment the rate of fuel delivery is increased to generate an air/fuel ratio rich of stoichiometry which results in a lower exhaust gas temperature. In another embodiment the rate of fuel delivery is gdecreased to generate an air/fuel ratio lean of stoichiometry which also results in a lower exhaust gas temperature. In such a manner the temperature of the first catalytic converter is controlled.

Figure 2:
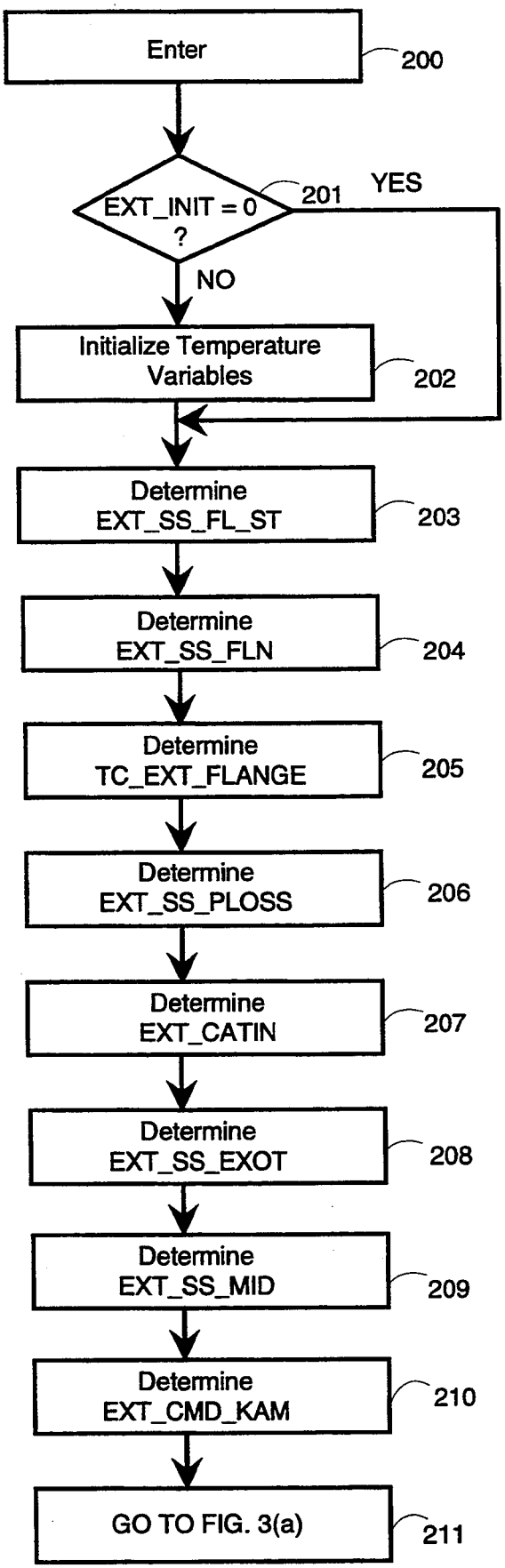
FIGS. 2 and 3(*a*), (*b*) and (*c*) are flowcharts showing the operation of a preferred embodiment of the invention.

FIGS. 2(*a*) and (*b*) and 3(*a*), (*b*) and (*c*) are flowcharts showing the steps in a routine performed by the EEC 100. In a preferred embodiment, the steps shown in FIGS. 2(*a*) and (*b*) and 3(*a*), (*b*) and (*c*) comprise a portion of a larger routine which performs other engine control functions. FIG. 2 shows the steps in a temperature determination routine performed by EEC 100 to determine the temperature of the midbed point of the first catalytic converter 32 during engine operation.

The temperature determination routine is entered at 200 and at 201 an initialization flag EXT_INIT is checked to determine if certain temperature variables have been initialized. A preferred embodiment advantageously initializes certain temperature variables in a manner to account for instances where an engine may be turned off for short periods of time in which the catalytic converter may not have cooled to an ambient temperature. Catalytic converter overtemperature conditions are accordingly reduced by estimating converter temperature upon engine ignition as a function of converter temperature upon engine shut off, ambient temperature, a time constant indicative of converter cooling and the time elapsed from engine shut off to subsequent engine operation. EXT_INIT will be set to a value of one when engine power is turned on so that the temperature variables may be initialized at 202. Once the variables are initialized, EXT_INIT is set to a value of zero and remains at such a value until engine operation is terminated. At 202 a plurality of variables to be used in the temperature determination routine are initialized as shown below:

$$EXT_FL_KAM = (EXT_FL_KAM - INFAMB_KAM) * FNEXP(-ENG_OFF_TMR/TC_SOAK_FL) + INFAMB_KAM \quad (1)$$

$$EXT_CMD_KAM = (EXT_CMD_KAM - INFAMB_KAM) * FNEXP(-ENG_OFF_TMR/TC_SOAK_CMD) + INFAMB_KAM \quad (2)$$

$$EXT_SS_FLN = EXT_FL_KAM \quad (3)$$

$$EXT_INIT = 1 \quad (4)$$

where,

EXT_FL_KAM is a value which is stored in keep alive memory 44 and which is indicative of an instantaneous temperature of exhaust gas at exhaust flange 75. As can be seen from equations (1) and (2) above, if the engine has been turned off for a long period of time, ENG_OFF_TMR will contain a large value, the exponential function will result in the first additive term on the right hand side of the equation equalling zero, and the temperature of the catalyst midbed and exhaust flange will equal the ambient temperature. For shorter periods of time the exponential function FNEXP will approximate the cooling off of the catalyst midbed. Because EXT_FL_KAM is stored in keep alive memory 44, upon initialization EXT_FL_KAM will advantageously contain the temperature of exhaust gas at exhaust flange 75 when the engine was last turned off, ENG_OFF_TMR is a variable which indicates the time, in seconds, that the engine has been turned off, TC_SOAK_FL is a calibratable time constant, in seconds, associated with the cooling off of exhaust gas at exhaust flange 75 when the engine is turned off, FNEXP() is a lookup table, stored in ROM 42 which approximates an exponential function for use by a fixed point processor in EEC 100, EXT_CMD_KAM is an instantaneous temperature value at midbed point 76 of catalytic converter 32, ENG_OFF_TMR is as previously described, TC_SOAK_CMD is an empirically derived time constant, in seconds, of the cooling off of exhaust gas at the catalyst midbed, INFAMB_KAM is a value indicative of an estimate of ambient air temperature in degrees fahrenheit.

At 203 a steady state temperature value indicative of a steady state temperature of the exhaust flange 75 at a stoichiometric air/fuel is calculated according to the following relationship:

$$EXT_SS_FL_ST = [FN4441(N,AIRCHG) * FN441B(SPKMBT - SAF) * FN441C(EGRACT)] + FN441(ACT) + FN441T(AM) * (ECT - 200) \quad (5)$$

where,

FN4441(N,AIRCHG) is an empirically derived value, contained in a table indexed by engine speed, N, and aircharge, AIRCHG, which is indicative of a base steady-state exhaust flange temperature, in degrees fahrenheit at a particular engine speed and aircharge at an A/F of 14.6 A/F, 0% EGR, MBT spark, and 200 degrees fahrenheit engine coolant temperature, FN441B(SPKMBT-SAF) is a value, contained in a table indexed by a spark delta, in degrees which is indicative of an effect of spark timing on the exhaust flange temperature, SPKMBT is spark timing for peak thermal efficiency know as maximum spark for best torque, (MBT), SAF is scheduled spark which may be retarded from SPKMBT for reduction of regulated emission or to prevent engine knock, the difference between SPKMBT and SAF equals a spark delta in degrees which is used to index table FN441B.

FN441I(ACF) is a unitless value, indicative of the effect of temperature of airflow into the engine, (air charge temperature or ACT) on exhaust flange temperature, FN441C(EGRACT) is a value, contained in a table indexed by level of exhaust gas recirculation, which is indicative of the effect of exhaust gas recirculation on the exhaust flange temperature, FN441T(AM) is a value, indexed by AM, which is indicative of a reduction in exhaust flange temperature per degree of engine coolant temperature below 200 degrees fahrenheit.

At 204 steady state temperature value EXT_SS_FL_ST is adjusted by a value which is a function of an air/fuel modulation variable LAMBSE in order to account for a change in exhaust temperature due to changing A/F, by the below relationship to produce a value EXT_SS_FLN which is indicative of steady state exhaust flange gas temperature:

$$EXT_SS_FLN = EXT_SS_FL_ST * FN441A(LAMBSE) \quad (6)$$

where,

EXT_SS_FL_ST is as described above, and

FN44 1A(LAMBSE) is a value contained in a table, and indexed by air/fuel modulation variable LAMBSE, which is indicative of the effect of LAMBSE on exhaust flange temperature.

At 205 a time constant TC_EXT_FLANGE which is indicative of a temperature rise of the exhaust flange 75 is calculated as a function of AM into the induction system according to the following relationship:

$$TC_EXT_FLANGE = FN442(AM) \quad (7)$$

where, FN442(AM) is a value obtained from a table, indexed by AM, as previously described, and is indicative of a time constant, in seconds, of the rise in exhaust flange temperature due to a step change in instantaneous predicted exhaust flange temperature versus airmass. This time constant is associated with the heat capacity of the metal from the combustion chamber to the exhaust flange.

An instantaneous value of the exhaust flange, EXT_FL_KAM, is then calculated as a function of the steady state exhaust flange temperature EXT_SS_FL, the time constant of the temperature rise, TC_EXT_FLANGE and the time required for execution of the background loop BG_TMR according to the following relationships:

$$EXT_FL_KAM = (1-FK) * EXT_FL_KAM + FK * EXT_SS_FLN \quad (8)$$

where, FK performs an exponential smoothing function according to the following relationship:

$$FK = 1/(1 + TC_EXT_FLANGE/BG_TMR).$$

At 206 a steady state temperature drop EXT_SS_PLOSS between exhaust flange 75 and exhaust gas inlet 77 of the first catalytic converter 32 is advantageously calculated according to the following relationship:

$$EXT_SS_PLOSS = FN445L(AM) * DELTA_T \quad (9)$$

where, FN445L(AM) is a unitless value, contained in a table indexed by mass flow rate of air AM, which is indicative of a temperature drop between exhaust flange and catalyst inlet as a function of AM, and DELTA_T is a value which is indicative of a temperature difference in degrees fahrenheit between the exhaust gas temperature at the exhaust flange and ambient temperature.

DELTA_T is preferably calculated according to the following relationship:

$$DELTA_T = VG_T - INFAMB_KAM \quad (10)$$

where,

INFAMB_KAM is as previously described, and

AVG_T is a value indicative of an average value of exhaust gas temperature from the exhaust flange 75 to the exhaust gas inlet 77 of the first catalytic converter.

AVG_T is preferably calculated according to the following relationship:

$$AVG_T = (EXT_FL_KAM + EXT_CATIN) \quad (11)$$

where,

EXT_FL_KAM is as previously described, and

EXT_CATIN is a value indicative*of the temperature of exhaust gas at exhaust gas inlet 77 of the first catalytic converter. The value contained in EXT_CATIN is calculated in a manner to be described below. As can be seen from FIG. 2, in a preferred embodiment, a value of EXT_CATIN which was calculated upon the prior execution of the steps in FIG. 2 is used in equation (11) above.

The temperature value, EXT_CATIN is calculated at 207 as a function of the instantaneous temperature of the exhaust flange 75, EXT_FL_KAM and of the steady state temperature drop between exhaust flange 75 and exhaust gas inlet 77, EXT_SS_PLOSS as shown below:

$$EXT_CATIN = EXT_FL_KAM - EXT_SS_PLOSS \quad (12)$$

At 208 a value, EXT_SS_EXOT which is indicative of the increase in temperature of the exhaust gas in first catalytic converter 32 due to the exothermic reaction of the exhaust gas with the catalyst material 82 and 84 is calculated according to the following relationship:

$$EXT_SS_EXOT = FN448(AM) * FN448A(LAMBSE) \quad (13)$$

where,

FN448(AM) is a value, contained in a table which is indexed by mass flow rate of air (AM), which is indicative of a relationship between temperature rise of exhaust gas in the catalytic converter as a function of air flow through the catalytic converter, and which preferably equals 1.0, and FN448A(LAMBSE) is a predetermined value, in degrees fahrenheit, indicative of a steady-state increase in exhaust temperature in the catalyst, and is stored as a function of LAMBSE. A steady state temperature value, EXT_SS_MID which is indicative of the steady state temperature at midbed point 76 of first catalytic converter 32 is then determined at 209 by adding the value EXT_SS_EXOT to the value EXT_CATIN as shown below:

$$EXT_SS_MID = EXT_CATIN + EXT_SS_EXOT. \quad (14)$$

At 210 an instantaneous temperature value for midbed point 76 is determined by first calculating a time constant value, TC_EXT_CATMID, indicative of a temperature rise of the exhaust gas in first catalytic converter 32 in seconds according to the following relationship:

$$TC_EXT_CATMID = FN449(AM) \quad (15)$$

where,

FN449(AM) is a value obtained from a table, indexed by AM, and is indicative of a time constant, in seconds, of the rise in catalyst midbed temperature due to a step change in instantaneous predicted exhaust flange temperature versus airmass (AM).

The instantaneous temperature value EXT_CMD_KAM is then determined at 210 as a function of the steady state midbed temperature value EXT_SS_MID, the time constant of the temperature rise of the midbed TC_EXT_CATMID 10 and BG_TMR according to the following relationship:

$$EXT_CMD_KAM \; (1-FK)*EXT_CMD_KAM + FK*EXT_SS_MID \quad (16)$$

where,

FK performs an exponential smoothing function according to the following relationship:

$$FK = 1/(1 + TC_EXT_CATMID/BG_TMR) \quad (17)$$

Figure 3A:
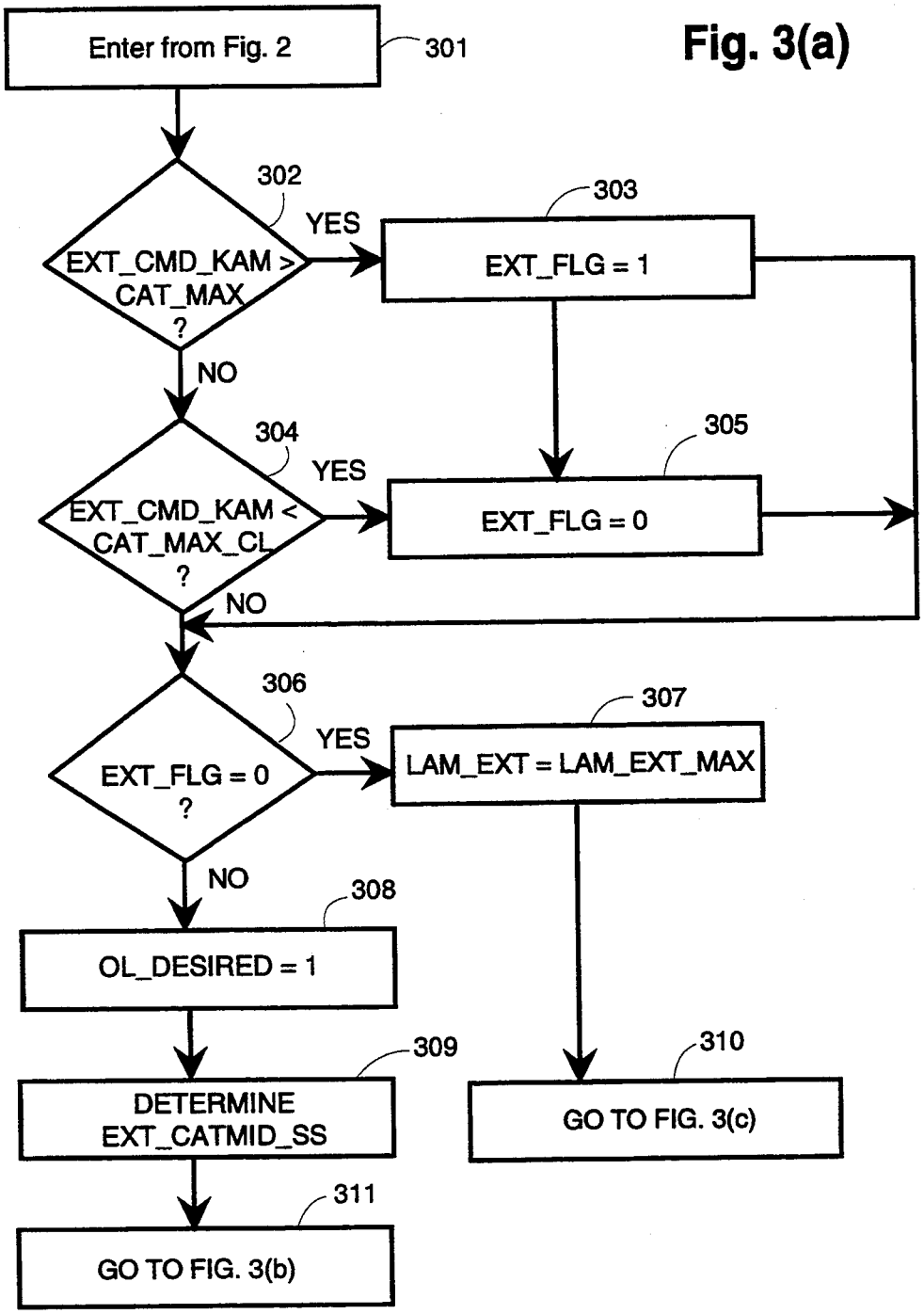
Figure 3B:
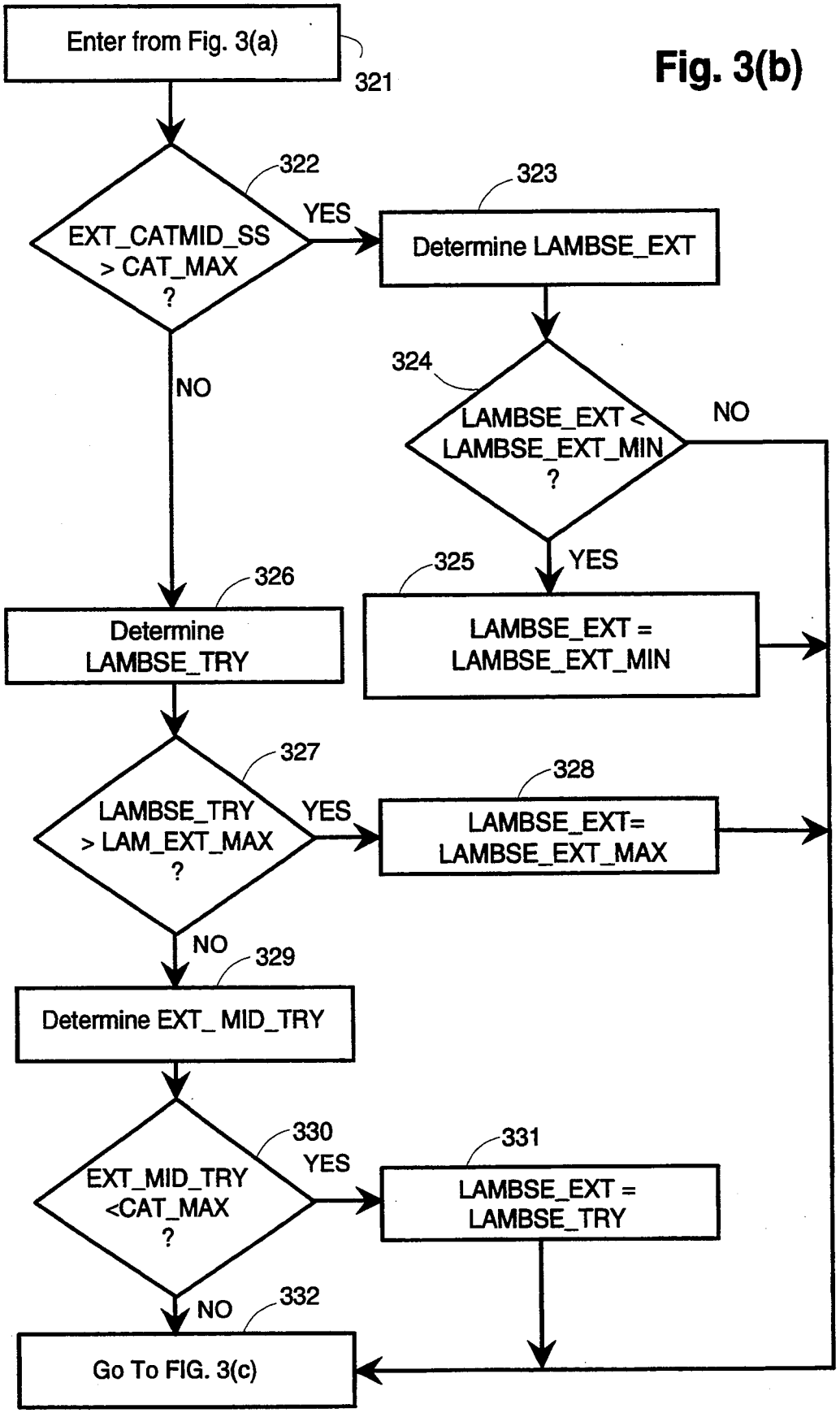
Figure 3C:
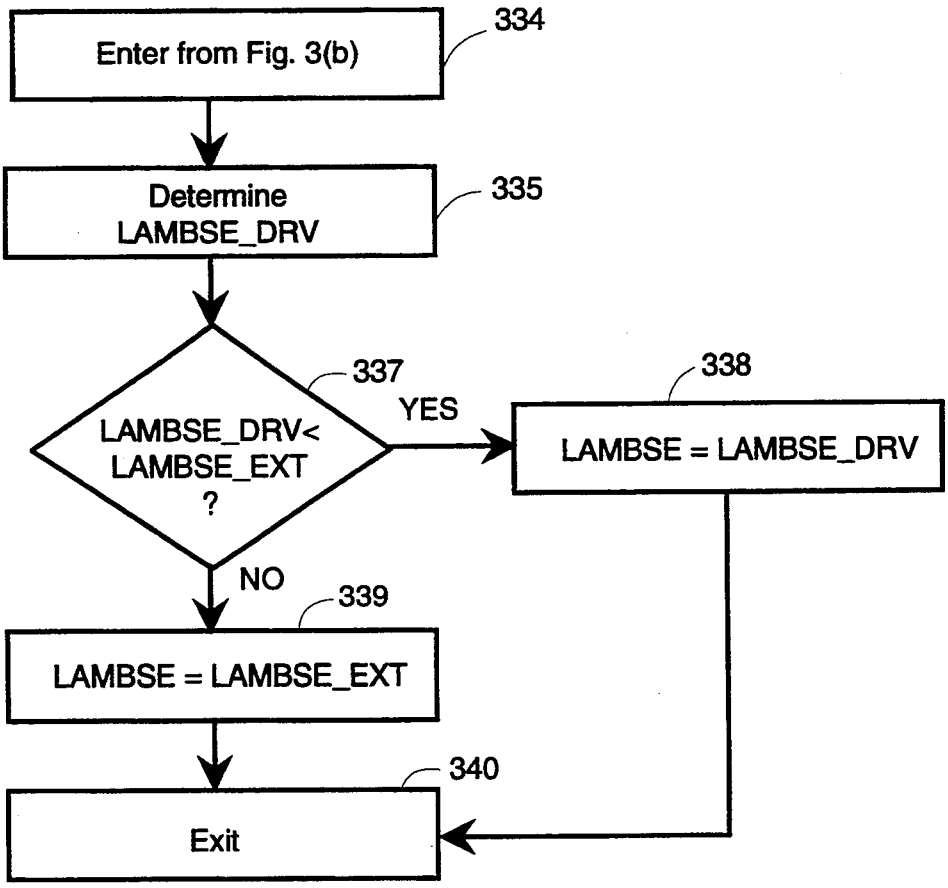

FIGS. 3(*a*), (*b*) and (*c*) show the steps in an air/fuel control routine performed by EEC 100 to control the midbed temperature of the first catalytic converter 32 by altering the composition of exhaust gas which is processed by the catalytic converter 32. A preferred embodiment advantageously alters the composition of the exhaust gas by controlling fuel delivery by injectors 14 to generate an air/fuel mixture comprising a particular ratio of air and fuel which results in a particular composition of exhaust gas upon combustion. The routine is entered at 301 and at steps 302 and 304 midbed temperature EXT_CMD_KAM is checked to determine if it is greater than a predetermined maximum midbed temperature CAT_MAX. At 302 instantaneous temperature value EXT_CMD_KAM is compared to CAT_MAX a maximum temperature value of a temperature range within which the air/fuel mixture is altered to lower the midbed temperature, herein referred to as a maximum midbed temperature range. If the midbed temperature is lower than CAT_MAX then an attempt to reduce the midbed temperature is not made. By reducing midbed temperature if it is within a certain range rather than above a single temperature value changes in air/fuel control are minimized, thus benefitting drivability. If EXT_CMD_KAM is greater than CAT_MAX then a temperature flag EXT_FLG is set at 303 to a value of one to indicate an overtemperature condition. If the midbed temperature EXT_CMD_KAM is less than CAT_MAX then at 304 the midbed temperature EXT_CMD_KAM is compared to a second temperature value CAT_MAX_CL which defines a minimum temperature valve for the maximum midbed temperature range. If midbed temperature EXT_CMD_KAM is less than CAT_MAX_CL then at 305 temperature flag EXT_FLG is set to a value of zero to indicate that the midbed temperature is less than the maximum midbed temperature range.

At 306 temperature flag EXT_FLG is checked and if EXT_FLG=0 then at 307 an air/fuel modulation variable LAM_EXT is set to a predetermined value LAM_EXT_MAX and the routine proceeds to execute the steps shown in FIG. 3(*c*). In a preferred embodiment LAM_EXT_MAX has a value of 0.9. If temperature flag indicates an overtemperature condition then at 308 an open loop control flag OL_DESIRED is set to a value of one to indicate to other routines executed by EEC 100 that the engine is to be operated under an open loop form of air/fuel control. This feature advantageously allows engine operation under closed-loop control only if the catalyst midbed temperature is below the allowable maximum temperature thus reducing the possibility of subjecting the catalyst to temperatures above the allowable maximum temperature.

At 309 a steady state value EXT_CATMID_SS of the midbed temperature is determined according to the following relationship and control of the routine proceeds to the steps shown in FIG. 3(*b*):

$$EXT_CATMID_SS = EXT_SS_FLN + EXT_SS_EXOT - EXT_SS_LOSS \quad (18)$$

where, EXT_CATMID_SS, EXT_SS_FLN, EXT_SS_EXOT and EXT_SS_PLOSS are as described above. The steady state temperature of the midbed point of the catalytic converter EXT_CATMID_SS is compared to the predetermined maximum catalyst midbed temperature value CAT_MAX at 322 and if the midbed temperature exceeds the predetermined maximum catalyst midbed temperature then at 323 the rate of fuel delivery to the engine is increased to result in a richer air/fuel ratio by decrementing first air_fuel modulation variable LAMBSE_EXT by a predetermined air/fuel alteration value LAM_EXT_STEP as shown below:

$$LAMBSE_EXT = LAMBSE_EXT - LAM_EXT_STEP*BG_TMR \quad (19)$$

where, LAMBSE_EXT and LAM_EXT_STEP are as shown below and BG_TMR is as previously described. As will be evident to those skilled in the art in view of the present disclosure, LAM_EXT_STEP allows a change in A/F to be achieved in incremental steps in order to reduce fluctuations in engine torque. LAM_EXT_STEP is advantageously multiplied by BG_TMR to modify the step size LAM_EXT_STEP in order to account for varying execution times of the background loop. As shown at 324 and 325, the value of first air/fuel modulation variable LAMBSE_EXT is advantageously limited to a predetermined minimum value, LAMBSE_EXT_MIN, in order to limit the amount of fuel delivered. This advantageous feature prevents a continual increasing of the fuel delivery rate in order to lower the temperature of the catalytic converter which may be increasing because of factors which cannot be controlled by altering the composition of the exhaust gas processed by the converter. At 324 LAMBSE_EXT is checked against LAMBSE_EXT_MIN and if LAMBSE_EXT is less than LAMBSE_EXT_MIN then at 325 LAMBSE_EXT is set equal to the minimum allowable value LAMBSE_EXT_MIN. Otherwise, if LAMBSE_EXT is not less than the minimum allowable minimum then the routine continues to the steps shown in FIG. 3(*c*).

If at 322 the steady state temperature of the midbed point of the catalytic converter EXT_CATMID_SS is not greater than the predetermined maximum catalyst midbed temperature value CAT_MAX then at step 326 a second, intermediate, air/fuel modulation value LAMBSE_TRY is generated by incrementing LAMBSE_EXT by predetermined air/fuel alteration value LAM_EXT_STEP as shown below:

$$\text{LAMBSE_TRY} = \text{LAMBSE_EXT} + \text{LAMBSE_EXT_STEP} * \text{BG_TMR} \quad (20)$$

where, LAMBSE_TRY, LAMBSE_EXT, LAMBSE_EXT_STEP and BG_TMR are as described above.

As shown above, predetermined air/fuel alteration value LAM_EXT_STEP is multiplied by BG_TMR to modify the step size LAM_EXT_STEP in order to account for varying execution times of the background loop. At 327 LAMBSE_TRY is compared to a predetermined maximum value LAM_EXT_MAX and at 328, LAMBSE_EXT is set equal to LAM_EXT_MAX if the value generated for LAMBSE_TRY at 326 results in a value which is greater than the predetermined maximum value LAM_EXT_MAX. Otherwise, if the value generated at 326 for second air/fuel modulation value LAMBSE_TRY results in a value which is within the range set by LAM_EXT_MAX then at 329 a catalyst midbed temperature which corresponds to an exhaust gas comprising an air/fuel ratio corresponding to the generated value of second air/fuel modulation value LAMBSE_TRY is estimated and is compared at 330 to maximum allowable catalyst midbed temperature CAT_MAX. This advantageous feature results in a stable A/F control system characterized by minimal A/F fluctuation by allowing the temperature of the catalytic converter to be increased if it is below the allowable maximum temperature CAT_MAX but reducing the chances of generating an exhaust gas mixture which results in a catalytic converter greater than the allowable maximum temperature.

At 329, EXT_MID_TRY, the midbed temperature corresponding to an exhaust gas mixture resulting from second air/fuel variable LAMBSE_TRY, is estimated according to the following relationship:

$$\text{EXT_MID_TRY} = \text{CEXT_SS_FL_ST} * \text{FN441A(LAMBSE_TRY)} + \text{FN448(AM)} * \text{FN448A(LAMBSE_TRY)}) - \text{EXT_SS_PLOSS} \quad (21)$$

where,

EXT_MID_TRY, EXT_SS_FL_ST, FN441A(LAMBSE_TRY), FN448(AM), EXT_SS_PLOSS, and FN448A(LAMBSE_TRY) are as described above.

At step 330 estimated midbed temperature EXT_MID_TRY is compared to allowable maximum midbed temperature CAT_MAX and at 331 first air/fuel modulation variable LAMBSE_EXT is set equal to second air/fuel modulation variable LAMBSE_TRY if the estimated midbed temperature resulting from LAMBSE_TRY is less than the allowable maximum midbed temperature. If at 330 the estimated temperature resulting from LAMBSE_TRY is determined to be greater than the allowable maximum midbed temperature then the existing value of LAMBSE_EXT is maintained, i.e. to the value determined in the prior execution of the air/fuel control routine.

In FIG. 3(*c*), a 335 third air/fuel modulation variable LAMBSE_DRV is generated to determine an air/fuel ratio to enhance engine drivability. Third air/fuel modulation variable LAMBSE_DRV is preferably generated to correspond to an A/F ratio which generates a predetermined engine response for a predetermined set of engine operating parameters which includes a stoichiometric A/F ratio at partial throttle or a rich A/F ratio at a high throttle position for maximum power. LAMBSE_DRV is preferably generated as a function of a plurality of engine operating parameters including throttle position, engine speed, mass air flow rate, engine coolant temperature and air temperature. As seen at steps 337, 338 and 339 third air/fuel modulation variable and second air/fuel modulation variable are compared and air/fuel modulation variable LAMBSE is set at 338 or 339 to the lower of the second or third modulation variables. In this manner, the temperature of the catalytic converter is effectively controlled and engine drivability is enhanced by selecting a value for air/fuel modulation variable LAMBSE which corresponds to the richer of two possible air/fuel ratios. At 340 the air/fuel control routine is exited and other engine control functions are performed by EEC 100.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. A method of limiting a maximum temperature of a catalytic converter which chemically alters an exhaust gas produced by combustion of an air/fuel mixture in an internal combustion engine, the method comprising the steps of:

determining an instantaneous temperature of a midbed point within said catalytic converter, generating a first air/fuel modulation variable indicative of a ratio of air to fuel in an air/fuel mixture required to alter the temperature of the midbed point by a predetermined amount, generating a second air/fuel modulation variable indicative of a ratio of air to fuel in an air/fuel mixture required to generate a predetermined engine response for a predetermined set of engine operating parameters, comparing said first air/fuel modulation variable to said second air/fuel modulation variable and injecting an amount of fuel to generate an air/fuel mixture-corresponding to said first air/fuel modulation variable if said first air/fuel modulation variable corresponds to a lesser proportion of air to fuel in said air/fuel mixture than said second air/fuel modulation variable and injecting an amount of fuel to generate an air/fuel mixture corresponding to said second air/fuel modulation variable if said first air/fuel modulation variable corresponds to a greater proportion of air to fuel than said second air/fuel modulation variable.

2. The method as set forth in claim 1 wherein the step of determining an instantaneous temperature of a midbed point within said catalytic converter comprises the steps of:

determining an instantaneous temperature of exhaust gas at a first point on an exhaust pipe, which transports exhaust gas from the engine to the catalytic converter, as a function of a first value indicative of a steady state temperature at the first point and as a function of a second value indicative of a predetermined temperature rate of change at the first point;

measuring a mass flow rate of air into an induction system of said engine;

determining an instantaneous temperature of exhaust gas at an exhaust gas inlet of said catalytic converter as a function of the instantaneous temperature at said first point and a third value indicative of a steady state temperature drop of said exhaust gas from said first point to said exhaust gas inlet;

determining a steady state temperature at a midbed point in said catalytic converter as a function of said instantaneous temperature at said exhaust gas inlet and a fourth value indicative of an increase in temperature of said exhaust gas in said catalytic converter; and determining the instantaneous temperature at the midbed point as a function of said steady state temperature at said midbed point and a predetermined temperature rate of change at the midbed point which varies as a function of said mass flow rate of air.

3. The method as set forth in claim 2 wherein the step of determining a temperature of the midbed point within said catalytic converter comprises an initial step of initializing said first air/fuel modulation variable upon engine ignition as a function of a temperature value indicative of the midbed temperature when the engine was last turned off, a time constant indicative of a rate of cooling of the catalyst midbed, and as a function of a time value indicative of the amount of time the engine was turned off.

4. The method as set forth in claim 3 wherein the step of generating said first air/fuel modulation variable comprises the further steps of:

comparing said temperature of said midbed point to a predetermined maximum temperature range comprising a maximum temperature value and a minimum temperature value and setting a temperature flag to indicate an overtemperature condition if said temperature of said midbed point is greater than said maximum temperature value and setting said temperature flag to indicate an undertemperature condition if said temperature of said midbed point is less than said minimum temperature value;

setting said first intermediate air/fuel modulation variable equal to a predetermined air/fuel modulation value if said temperature flag indicates said undertemperature condition; and altering said first intermediate air/fuel modulation variable by an air/fuel modulation alteration value if said temperature flag indicates said overtemperature condition.

5. The method as set forth in claim 4 wherein the step of altering said first intermediate air/fuel modulation variable by an air/fuel modulation alteration value comprises the steps of, calculating a steady state temperature value indicative of a steady state temperature at said midbed point in said catalytic converter, comparing said steady state temperature value to said maximum temperature value and if said steady state temperature value is greater than said maximum midbed temperature value then decrementing said first intermediate air/fuel modulation variable by said air/fuel alteration value, and if said steady state temperature value is less than or equal to said maximum temperature value then, generating a third intermediate air/fuel modulation variable by incrementing said first intermediate air/fuel modulation variable by said air/fuel alteration value, calculating an estimated temperature value at said midbed point in said catalytic converter which corresponds to an air/fuel ratio generated from said third intermediate air/fuel modulation variable, and comparing said estimated temperature value to said maximum temperature value and setting said first intermediate air/fuel modulation variable equal to said third intermediate air/fuel modulation variable if said estimated temperature value is less than or equal to said maximum temperature value.

6. The method as set forth in claim 5 wherein the step of determining an instantaneous temperature of said exhaust gas at a first point on the exhaust pipe comprises the step of generating the first value indicative of a steady state temperature of exhaust gas at the first point as a function of a value which is indicative of a base steady-state temperature at the first point at a particular engine speed and aircharge, a value which is indicative of an effect of engine spark timing on the temperature of exhaust gas at the first point, a value which is indicative of an effect of exhaust gas recirculation on the temperature of exhaust gas at the first point, a value which is indicative of an effect of aircharge temperature on the temperature of exhaust gas at the first point and a value which is indicative of an effect of engine coolant temperature on the temperature of exhaust gas at the first point.

7. The method as set forth in claim 2 wherein the step of determining the third value indicative of a steady state temperature drop of said exhaust gas from said first point to said exhaust gas inlet comprises the steps of:

determining a fifth value indicative of an average value of exhaust gas temperature from the first point to the exhaust gas inlet of the catalytic converter, determining, as a function of said fifth value and a value indicative of an ambient temperature, a sixth value indicative of a temperature difference between the exhaust gas temperature at the first point and the ambient temperature, retrieving a seventh predetermined value, indicative of a temperature drop of exhaust gas between the first point and the exhaust gas inlet of the catalytic converter, and determining the third value as a function of the sixth value and the seventh predetermined value.

8. A method of limiting a maximum temperature in a catalytic converter which alters exhaust gases produced by combustion of an air/fuel mixture in an internal combustion engine which includes an exhaust pipe for transporting exhaust gases produced by the engine into a catalytic converter, the method comprising the steps of:

determining an instantaneous temperature value at a midbed point in said catalytic converter by the steps of, determining an instantaneous temperature of exhaust gas at a first point on said exhaust pipe as a function of a first value indicative of a steady state temperature at the first point and as a function of a second value indicative of a predetermined temperature rate of change at the first point;

measuring a mass flow rate of air into an induction system of said engine;

determining an instantaneous temperature of exhaust gas at an exhaust gas inlet of said catalytic converter as a function of the instantaneous temperature at said first point and a third value indicative of a steady state temperature drop of said exhaust gas from said first point to said exhaust gas inlet;

determining a steady state temperature at a midbed point in said catalytic converter as a function of said instantaneous temperature of exhaust gas at said exhaust gas inlet and a fourth value indicative of an increase in temperature of said exhaust gas in said catalytic converter;

determining said instantaneous temperature value at said midbed point as a function of said steady state temperature at said midbed point and a predetermined temperature rate of change of the midbed point which varies as a function of said mass flow rate of air; and controlling said air/fuel ratio in response to said instantaneous midbed temperature to maintain said midbed temperature within a predetermined midbed temperature range.

9. The method as set forth in claim 8 wherein the second value is a function of the mass flow rate of air into the induction system and is stored in a non-volatile memory.

10. The method as set forth in claim 9 wherein the third value is a function of a predetermined value indicative of a temperature difference between the first point and the exhaust gas inlet of the catalytic converter and which varies as a function of the mass flow rate of air into the induction system and wherein the third value is additionally a function of a value indicative of a temperature difference between exhaust gas at the first point and an ambient temperature.

11. The method as set forth in claim 10 wherein the value indicative of a temperature difference between exhaust gas at the first point and an ambient temperature is a function of a value indicative of an average value of exhaust gas temperature from the first point to the exhaust gas inlet of the catalytic converter and a value indicative of the ambient temperature.

12. The method as set forth in claim 11 wherein the fourth value is determined as a function of the mass flow rate of air into the induction system and as a function of an air/fuel mixture combusted in the engine.

13. In an internal combustion engine comprising a means for generating an air/fuel mixture for combustion within said engine and an exhaust pipe for transporting exhaust gases produced from said combustion of said air/fuel mixture to a catalytic converter, a method of controlling delivery of fuel to a combustion chamber of the engine to generate said air/fuel mixture, which comprises a ratio of air to fuel required to maintain said catalytic converter within a predetermined temperature range, the method comprising the steps of:

determining an instantaneous temperature value at a midbed point in said catalytic converter;

altering said air/fuel mixture by the steps of, comparing said instantaneous temperature value to a predetermined maximum catalyst midbed temperature range comprising a maximum temperature value and a minimum temperature value and setting a temperature flag to indicate an overtemperature condition if said instantaneous temperature value is greater than said maximum temperature value and setting said temperature flag to indicate an undertemperature condition if said instantaneous temperature value is less than said minimum temperature value;

setting a first intermediate air/fuel modulation variable equal to a predetermined air/fuel modulation value if said temperature flag indicates said undertemperature condition;

altering said first intermediate air/fuel modulation variable by an air/fuel modulation alteration value if said temperature flag indicates said overtemperature condition;

generating a second intermediate air/fuel modulation variable indicative of a ratio of air to fuel in an air/fuel mixture required to generate a predetermined engine response for a predetermined set of engine operating parameters, comparing said second intermediate air/fuel modulation variable to said first intermediate air/fuel modulation variable and injecting an amount of fuel to generate an air/fuel ratio corresponding to said second intermediate air/fuel modulation variable if said first air/fuel modulation variable corresponds to a greater proportion of air to fuel than said second air/fuel modulation variable, and injecting an amount of fuel to generate an air/fuel ratio corresponding to said first intermediate air/fuel modulation variable if said first air/fuel modulation variable corresponds to a lesser proportion of air to fuel than said second air/fuel modulation variable.

14. The method as set forth in claim 13 wherein the step of determining an instantaneous temperature value at a midbed point in said catalytic converter comprises the step of:

determining an initial temperature value of said midbed point as a function of a temperature value indicative of the midbed temperature when the engine was last turned off, a time constant indicative of a rate of cooling of the catalyst midbed, and as a function of a value indicative of the amount of time the engine was turned off.

15. The method as set forth in claim 14 wherein the step of altering said first intermediate air/fuel modulation variable by an air/fuel modulation alteration value comprises the steps of, calculating a steady state temperature value indicative of a temperature at said midbed point in said catalytic converter, comparing said steady state temperature value to said predetermined maximum catalyst midbed temperature value and if said steady state temperature value is greater than said predetermined maximum catalyst midbed temperature value then decrementing said first intermediate air/fuel modulation variable by said air/fuel alteration value, and if said steady state temperature value is less than or equal to said predetermined maximum catalyst midbed temperature value then, generating a third intermediate air/fuel modulation variable by incrementing said first intermediate air/fuel modulation variable by said air/fuel alteration value, calculating an estimated temperature value at said midbed point in said catalytic converter which corresponds to an air/fuel ratio generated from said third intermediate air/fuel modulation variable, and comparing said estimated temperature value to said predetermined maximum catalyst midbed temperature value and setting said first intermediate air/fuel modulation variable equal to said third intermediate air/fuel modulation variable if said estimated temperature value is less than said predetermined maximum catalyst midbed temperature value.

* * * * *